United States Patent [19]

Costigan

[11] 4,155,543

[45] May 22, 1979

[54] CATCHER CONSTRUCTION FOR CLOTH-LAYING MACHINE

[75] Inventor: Conrad A. Costigan, Richmond Hill, N.Y.

[73] Assignee: Cutting Room Appliances Corporation, Hicksville, N.Y.

[21] Appl. No.: 842,561

[22] Filed: Oct. 17, 1977

[51] Int. Cl.[2] ..... B65H 29/46

[52] U.S. Cl. ..... 270/30

[58] Field of Search ..... 270/30–31; 269/25 R

[56] References Cited

U.S. PATENT DOCUMENTS

| | | | |
|---|---|---|---|
| 2,924,450 | 2/1960 | Deichmann | 270/31 |
| 3,051,475 | 8/1962 | Kibler | 270/31 |
| 3,497,204 | 2/1970 | Grimm | 270/30 X |

*Primary Examiner*—Edgar S. Burr
*Assistant Examiner*—A. Heinz
*Attorney, Agent, or Firm*—Joseph P. Gastel

[57] ABSTRACT

An end catcher for a one-way cloth-laying machine having a protruding cutter box assembly, including an actuator rod adapter mounted on the cloth-laying machine, an end catcher assembly including a base secured to a cloth-laying table, first and second frame sides mounted for linear horizontal movement on the base by means of first roller assemblies secured to the base and received in horizontal slots in the frame sides, an end catcher bar mounted on second roller assemblies received in vertical slots in the first and second frame sides, and cams attached to the end catcher bar for engagement by the actuating rod so as to cause the second roller assemblies and the end catcher bar attached thereto to be lifted relative to the first and second frame sides, while the first roller assemblies in the horizontal slots permit the frame sides to move in a direction away from the machine to thereby provide clearance for the cutter box assembly on the machine.

6 Claims, 12 Drawing Figures

CATCHER CONSTRUCTION FOR CLOTH-LAYING MACHINE

BACKGROUND OF THE INVENTION

The present invention relates to an improved end catcher construction for a cloth-laying machine having a protruding cutter box assembly which precludes the use therewith of conventional end catcher assemblies.

By way of background, there are in existence certain types of cloth-laying machines having a protruding cutter box assembly. These cloth-laying machines are made to lay cloth in a single direction only and the laid cloth is severed from the roll of cloth on the machine at one end of machine travel. Thereafter, the machine travels to the opposite end of the cloth-laying table without laying cloth. After the machine reverses its direction at the opposite end of the table, the free end of the cloth is fed from the machine onto the table.

In the past, machines of this type generally did not have an end catcher associated therewith for gripping the free end of the laid cloth because the linear rate of cloth being fed from the machine equaled the linear rate of movement of the machine on the table. However, for certain applications, as where it is desired to tension the cloth being laid, it is desirable to have an end catcher for gripping the free end of the laid cloth. The end catcher is essentially a device having a certain amount of weight which lays on the cut end of the cloth to prevent it from being pulled by the machine. However, conventional end catchers cannot be used with a cloth-laying machine of the foregoing type because, as noted above, the cutter box assembly must at the end of machine travel occupy the location which is normally occupied by an end catcher, and therefore, the conventional end catcher cannot be used because there would be interference between it and the cutter box on the machine.

SUMMARY OF THE INVENTION

It is accordingly the primary object of the present invention to provide an end catcher construction for use with a cloth-laying machine having a cutter box associated therewith and which lays cloth only in a single direction. Another object of the present invention is to provide an improved end catcher assembly which will firmly grip the cut end of the laid cloth and which will function in a manner which is entirely compatible with an existing cloth-laying machine having a cutter box.

A further object of the present invention is to provide an improved end catcher assembly for a cloth-laying machine which is entirely compatible with existing one-way cloth-laying machines and can be provided as an accessory thereto. Other objects and attendant advantages of the present invention will readily be perceived hereafter.

The present invention relates to an end catcher for a cloth-laying machine comprising actuating means mounted on said cloth-laying machine, an end catcher frame, end catcher means for resting on an end of spread cloth, first means mounting said end catcher means on said frame for vertical movement, second means for mounting said end catcher means for movement with said machine in the direction of machine travel to thereby maintain a predetermined minimum distance between said end catcher means and said machine during at least a portion of said travel with said machine, and engagement means mounted relative to said end catcher means for engagement by said actuating means to thereby effect said vertical movement and said movement with said machine.

The various aspects of the present invention will be more fully understood when the following portions of the specification are read in conjunction with the following drawings wherein:

DESCRIPTION OF THE PREFERRED EMBODIMENTS

Figure 1:
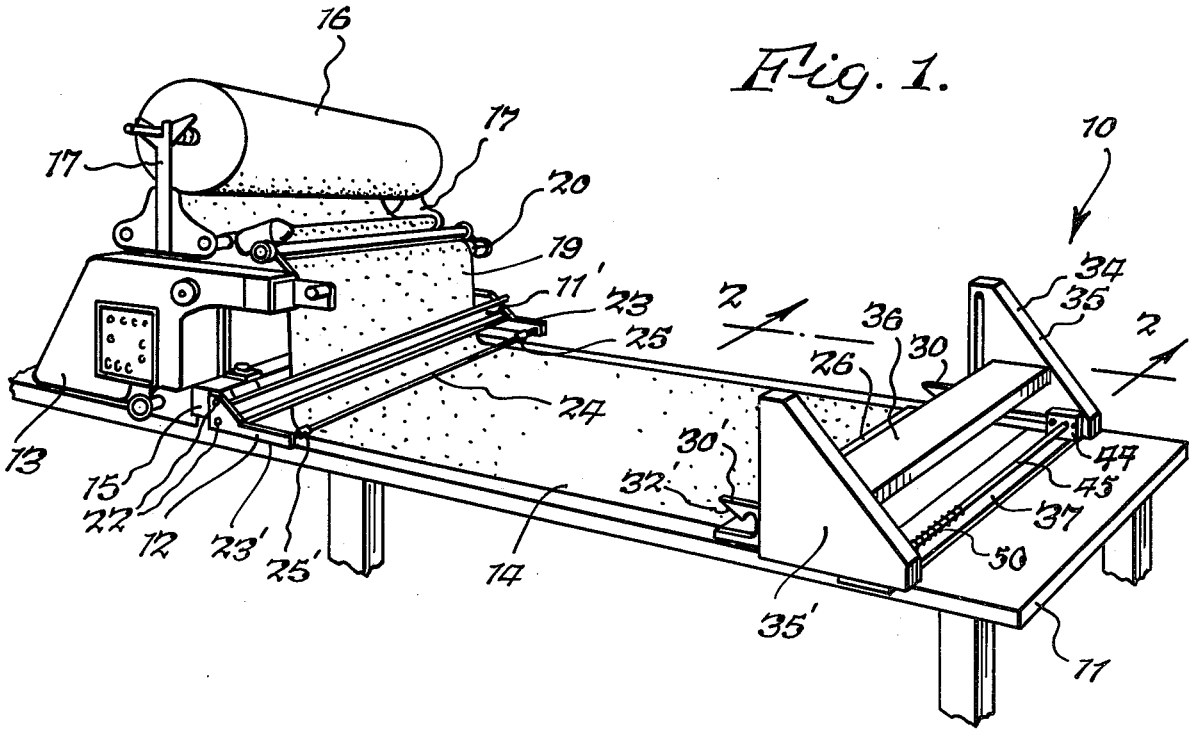
FIG. 1 is a fragmentary perspective view of the improved end catcher construction mounted on a cloth-laying table and an adapter for use with the improved end catcher construction mounted on a cloth-laying machine.

In FIG. 1 the improved end catcher 10 is shown mounted on cloth-laying table 11 for actuation by an adapter 12 which is mounted on cloth-laying machine 13. Cloth-laying machine 13 is of the type which lays cloth 14 in a manner which is known as "one-way spreading." In this respect, the cloth is laid with one side thereof up and to accomplish this, the machine travels to the right without laying cloth and it lays the cloth only when it is moving to the left. At the end of its movement to the left, a cutter mechanism, which is located within cutter box assembly 15, severs the laid cloth from the roll. Thereafter, the machine 13 travels to the right without laying cloth until it again starts its movement to the left. Cloth-laying machine 13 may be of the type which is known in the art as a "CRA Presto Trigger Champion" and this machine and its cutting mechanism are shown in U.S. Pat. No. 3,941,366.

Insofar as pertinent here, it need merely be understood that machine 13 mounts cloth roll 16 on a pair of standards 17. The web 19, being unwound from cloth roll 16, passes over a plurality of rollers on the machine and thereafter passes over feed roller 20 which plays out web 19 at the same linear rate at which the machine 13 is moving to the left so that the cloth 14 will be laid on the table. The web 19, during laying, passes through the cutter box assembly 15 which severs the cloth 14 which is laid from web 19 at the end of travel to the left and by a suitable brake mechanism 11' holds the cut end of the cloth while the machine 13 travels to the right, the brake releasing the cloth when the feed roller is again actuated when the machine 13 moves to the left. This is shown in U.S. Pat. No. 3,941,366, which is incorporated by reference herein.

Normally an end catcher is not used with a machine of the above-described type because of the fact that the cloth 14 which is laid is played out at the same linear rate as the linear rate of machine movement on the cloth-laying table. However, under certain circumstances it may be desired to place the laid cloth 14 under slight tension, and to do this, the end catcher 10 is used to clamp the free end of the cloth 14 to the table. However, with a machine of the foregoing type, the normal state of the art end catcher will not operate because of the fact that the knife box 15 protrudes in such a manner that it will interfere with the normal state of the art end catcher. This can be more fully understood by reference to FIG. 9 wherein the extreme right position of the knife box 15 is shown relative to the ends 21 of the laid cloth 14. Actually, the end 19' of web 19 does not line up with the ends 21 of laid cloth 14 until the knife box 15 has moved to the position of FIG. 10 from the position of FIG. 9 during movement of machine 13 to the left because, as noted above, the web 19 is played out at a linear rate which is equal to the linear rate of travel of machine 13 to the left on the table. The practical significance of the foregoing is that in order to cause end 19' to line up with ends 21, knife box 15 must be well to the right of ends 21, and this being the case it would interfere with the operation of a normal type of end catcher assembly.

Figure 3:
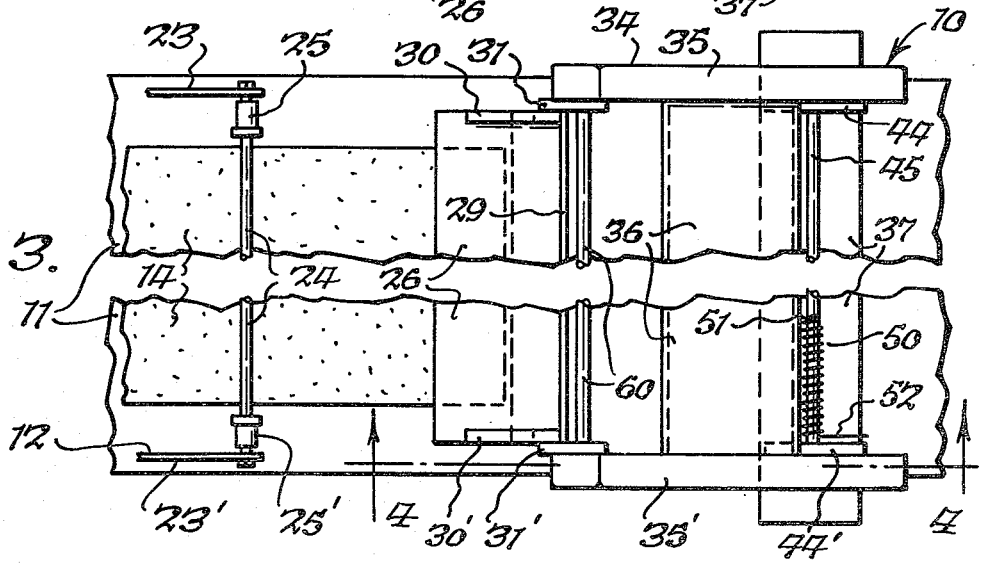
FIG. 3 is a fragmentary plan view showing a portion of the adapter which is mounted on the cloth-laying machine and also showing the end catcher.
Figure 7:
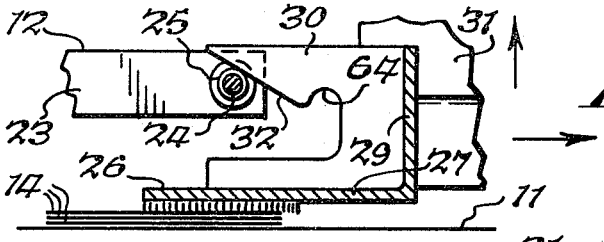
FIG. 7 is a fragmentary cross sectional view taken substantially along line 2—2 of FIG. 1 and showing the relationship between the adapter on the cloth-laying machine and the cam on the end catcher at the initial point of contact therebetween.

The improved end catcher 10 is caused to move to the right from its position shown in FIGS. 1 and 7 to the position shown in FIG. 9 so as to permit the cloth to be laid as described above relative to FIGS. 9 and 10 and thereafter catch the free end of the laid cloth. In this respect, an adaper 12 is attached to cutting box 15 by means of a pair of bolts 22 on each side of the cutter box 15. In this respect, the adapter 12 consists of a pair of mirror image counterpart arms 23–23', each attached to the cutter box 15 by a pair of bolts 22. A rod 24 has its opposite ends supported on arms 23–23'. A pair of mirror image counterpart plastic bushings or sleeves 25–25' are mounted on rod 24 proximate arms 23–23', as shown in FIG. 3.

When the end catcher assembly 10 is engaged by bushings 25–25', the end catcher bar 26 is lifted off of the end of the cloth-lays 14 and moved to the right, along with the remainder of the frame on which it is mounted to provide clearance for the cutter box 15. More specifically, end catcher bar 26 comprises an angle member having a horizontal leg 27 and a vertical leg 29. A suitable pad 26' is secured to the underside of leg 27. A pair of mirror image counterpart cams 30–30' are suitably secured, as by welding, to the ends of catcher bar 26. Cams 30 and 30' are in turn affixed as by welding to mirror image counterpart plates 31 and 31', respectively.

Figure 4:
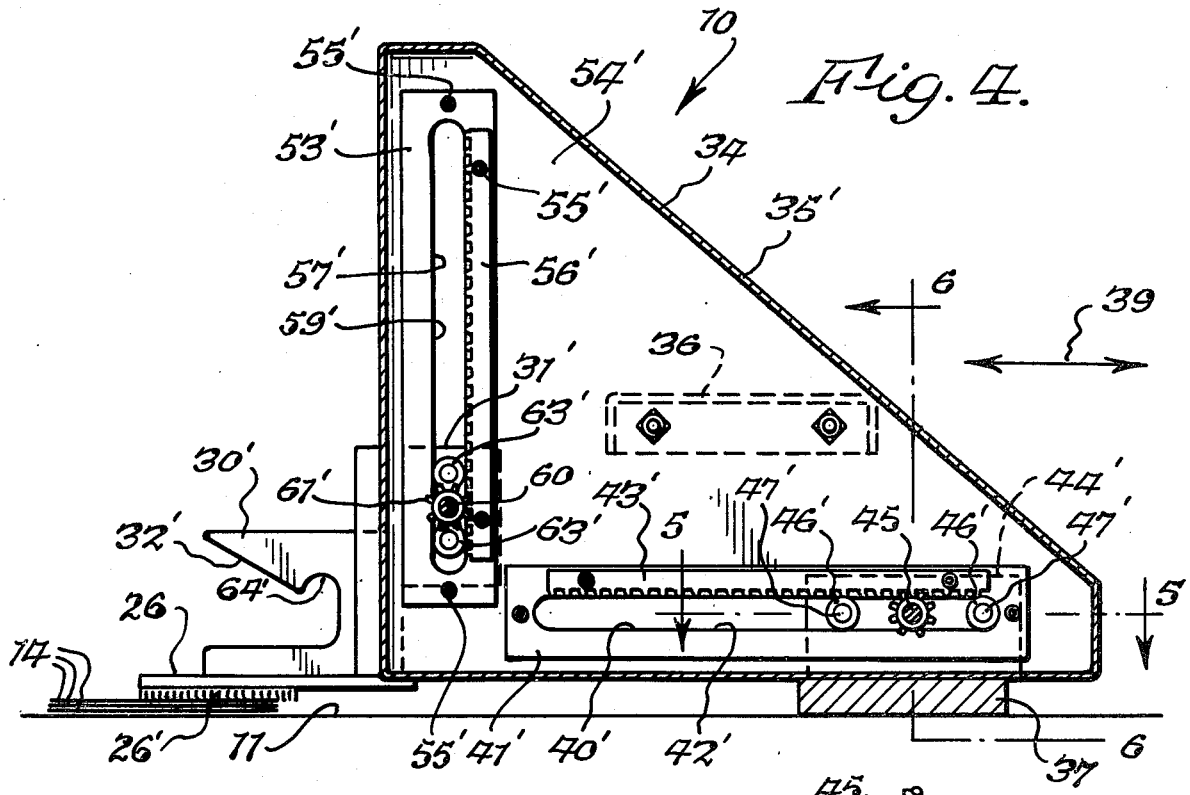
FIG. 4 is a cross sectional view taken substantially along line 4—4 of FIG. 3 and showing the structure for causing the catcher bar to move both in a horizontal and a vertical direction.
Figure 8:
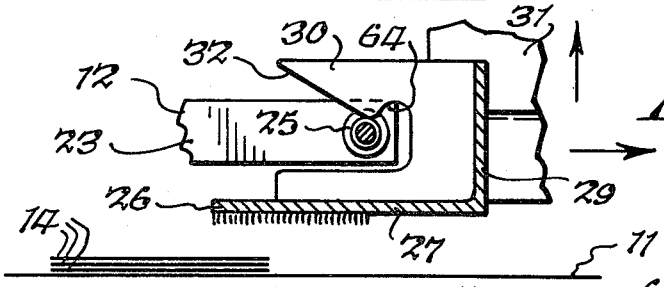
FIG. 8 is a view similar to FIG. 7 but showing the relative movement between the adapter and the cam and also showing the initial portion of movement of the end catcher from its normal at-rest position.

When laying machine 13 moves sufficiently to the right, a point will be reached where bushings 25–25' engage surfaces 32–32' of cams 30–30'. The initial point of engagement is shown in FIG. 7. Continued movement of adapter 12 to the right will cause cams 30–30' to be moved to the right and lifted to the position shown in FIG. 8. In this respect, the movement of the right is of the entire frame 34 of the end catcher. In this respect, the frame consists of two mirror image counterpart side frame members 35–35' which are connected by a channel 36. Mirror image counterparts are designated by a plain numeral and a corresponding primed numeral. Side frame members 35–35' are supported on base 37 for movement in the direction of arrows 39 (FIG. 4). Base 37 in turn is suitably clamped or bolted to the top of table 11.

Figure 6:
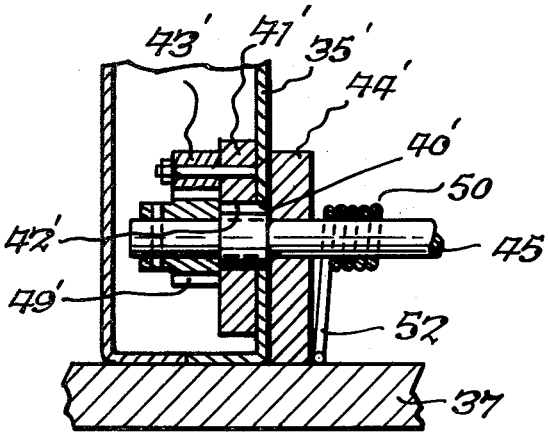
FIG. 6 is a fragmentary cross sectional view taken substantially along line 6—6 of FIG. 4.

The movement of frame sides 35–35' to the right results from the manner in which they are mounted. In this respect, frame members 35–35' include slots 40–40'. A plate 41' is suitably secured to frame 35' and plate 41' includes a slot 42' in alignment with slot 40' (FIG. 6). A rack 43' is suitably secured to plate 41'. Frame side 35 includes elements of structure which are the mirror image counterparts of elements 40', 41', 42' and 43', as well as of the other primed numerals.

Figure 5:
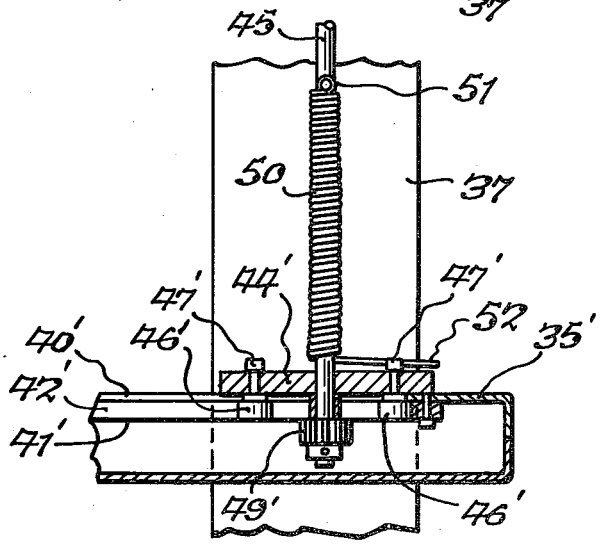
FIG. 5 is a fragmentary cross sectional view taken substantially along line 5—5 of FIG. 4 and showing further details of the structure for causing horizontal movement of the end catcher and also showing the spring structure for returning the end catcher to its normal at-rest position.

Blocks 44–44' are suitably secured, as by bolts or welding to base plate 37 (FIGS. 1 and 6). A rod 45 has opposite end portions journalled in blocks 44–44'. Spaced rollers 46' are journalled on pins 47' which are mounted on block 44' (FIG. 5). Rollers 46' are received in slot 42' of plate 41'. Structural elements which are the mirror image counterparts of elements 46' and 47' are associated with side frame member 35 and are designated by corresponding unprimed numerals. It can therefore be seen that side frame members 35–35' can move back and forth in the direction of arrows 39 (FIG. 4) because they are supported on rollers 46' and counterpart structure.

A pinion 49' is keyed to one end of shaft 45 and a counterpart pinion is keyed to the other end. Therefore, as frame sides 35–35' move to the right in FIG. 4, the engaging relationship between pinion 49' and rack 43' (and the counterpart rack-pinion engagement in frame side 35) will cause shaft 45 to rotate to wind up spring 50 which has end 51 attached to shaft 45 and end 52 held stationary relative to base 37. Thus, rollers 46 and 46' will support frame sides 35–35' for movement in the direction of arrows 39 and the tensioning of spring 50 will cause the frame sides 35–35' to return to the position shown in FIG. 4 when the force moving them to the right is relieved. The limit of movement of frame sides 35–35' to the left is determined by engagement between the right roller 46' and the right end of slot 42' (FIG. 4). However, when frame sides 35–35' move to the right under the urging of adapter 12, the frame sides will preferably cease their movement to the right before left roller 46' engages the left end of slot 42'.

Figure 2:
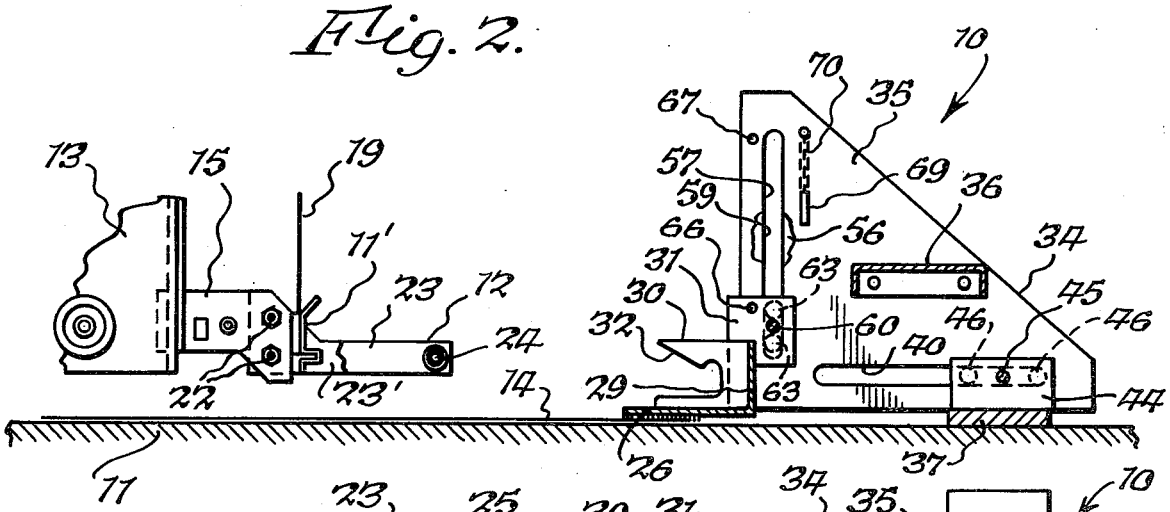
FIG. 2 is a fragmentary cross sectional view taken substantially along line 2—2 of FIG. 1.

A structure analogous to blocks 44–44' and their associated rollers and pinions is used to provide vertical movement to end catcher 26. In this respect, blocks 31–31' are provided for floating vertical movement in the frame sides. In this respect, frame side 35' includes a plate 53′ secured to side 54′ of the frame side, as by screws 55′. A rack 56′ is secured to plate 53′. A slot 57′ is located in plate 53′ and an aligned slot 59′ is located in side 54′. Mirror image counterpart structure corresponding to parts 53′, 56′, 57′ and 59′ is associated with frame side 35. A rod 60 has its opposite ends journalled in blocks 31–31′ and mounts a pinion such as 61′ at each opposite end. Pinion 61′ is in mesh with rack 56′ and the mirror image counterpart of pinion 61′ is in mesh with the mirror image counterpart of rack 56′. Rollers 63′ are mounted on block 31′ and ride in slot 59′. Mirror image counterpart rollers 63 (FIG. 2) ride in a slot analogous to slot 57′. Thus, the rollers 63–63′ permit blocks 31–31′ to ride vertically in the slots in the frame sides and the cooperation between the rack and pinions on the opposite frame sides will maintain blocks 31–31′ in exact parallelism.

As noted previously, as soon as bushings 25–25′ engage cam surfaces 32–32′, the end catcher bar 26 will be raised, and continued movement of bar 24 to the right in FIG. 7 will provide a horizontal component also moving catcher bar 26 to the right, along with frame sides 35–35′ because of the structure discussed in detail above. The relative movement between bushings 25–25′ and cams 30–30′ will continue until the bushings 25–25′ enter the enlarged slots 64–64′ in a detent-like engaging relationship, at which time the frame sides 35–35′ will be pushed to the right to the position of FIG. 9 but there will be no further raising action of end catcher bar 26. Furthermore, once bushings 25–25′ are received in slots 64–64′ a predetermined minimum distance will be maintained between the end catcher bar 26 and machine 13 so that there can be no interference therebetween.

Figure 9:
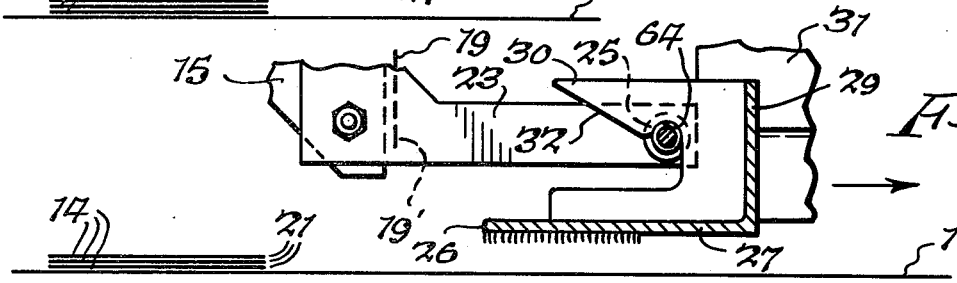
FIG. 9 is a view similar to FIG. 8 but showing the orientation of the adapter and the cam at the limit of movement of the end catcher to the right.
Figure 10:
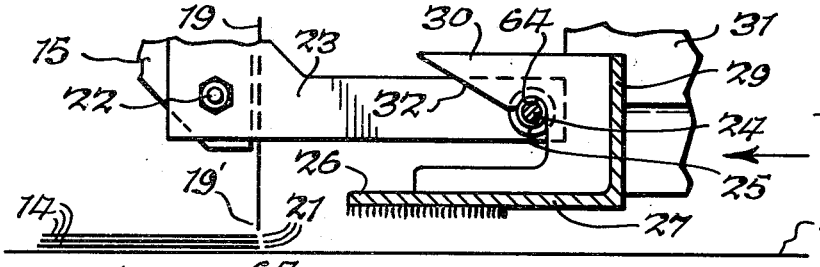
FIG. 10 is a view similar to FIG. 9 but showing the adapter and the cam traveling together toward the left.
Figure 11:
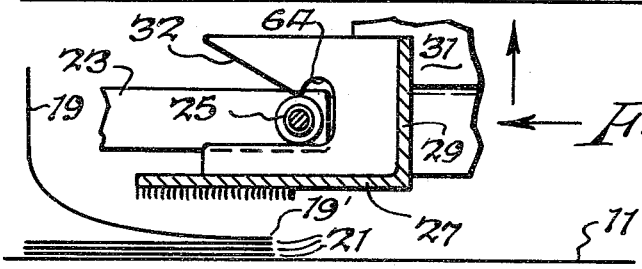
FIG. 11 is a view similar to FIG. 10 but showing the initial disengaging action between the adapter and the cam after the end catcher has reached its limit of movement to the left.
Figure 12:
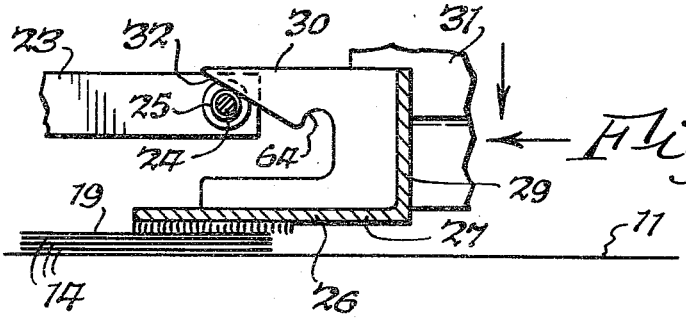
FIG. 12 is a view similar to FIG. 11 but showing the relative positions of the adapter and the cam at the instant of disengagement therebetween as the cloth-laying machine continues to move to the left.

FIG. 9, as noted above, denotes the limit of travel to the right of the end catcher bar assembly 10. At this time the cut end 19′ of cloth web 19 will be in the position shown. Immediately thereafter the machine will start moving to the left in FIG. 1, and because of the engagement between bushings 25–25′ and slots 64–64′, the catcher assembly 10 will be pulled with machine 13 to the left. This movement to the left will also be aided by the unwinding action of spring 50. The movement to the left is shown in FIG. 10. Movement of the end catcher assembly 10 to the left will continue until the right roller 46′ (FIG. 4) engages the right end of slot 42′, and a corresponding action occurs at the other end of shaft 45. At this time, continued movement of adapter 12 to the left will result in separation of bushings 25–25′ from slots 64–64′. However at this time the catcher bar 26 is in direct overlying relationship to the end of the web being laid because the movement to the left of the machine will result in web 19 assuming the orientation shown in FIG. 11. Continued movement of adapter 12 to the left will result in bushings 25–25′ riding under cam surfaces 32–32′ so as to gently lower catcher bar 26 onto the web of fabric which has just been laid, as can be seen from FIG. 12.

As noted above, after machine 13 reaches its limit of movement to the left, the web 19 is severed from the remainder of roll 16 by the action of a suitable cutter in cutter box 15 and machine 13 moves to the right without laying cloth and engages the end catcher assembly 10 and continues to move to the right with the end catcher assembly 10. Thereafter, it will reverse direction and start laying cloth as described above and end catcher assembly 10 will function to catch the free end of the cloth web to hold it.

If for any reason it is desired to move the catcher bar 26 to an out-of-the-way position for a period of time, all that is necessary is to raise it until aperture 66 in block 31 is in alignment with aperture 67 in frame side 35 and thereafter a pin 69 is inserted through the aligned apertures, pin 69 being mounted on frame side 35 by means of a chain 70.

While the present specification and claims refer to a cloth-laying machine and to cloth laid thereby, it will be appreciated that this terminology is intended to be generic and to be directed to machines of this type for laying any type of fabric or plastic.

It can thus be seen that the improved end catcher assembly of the present invention is manifestly capable of achieving the above-enumerated objects, and while preferred embodiments of the present invention have been disclosed, it will be appreciated that the present invention is not limited thereto but may be otherwise embodied within the scope of the following claims.

What is claimed is:

1. An end catcher for a cloth-laying machine comprising an end catcher frame, end catcher means mounted on said end catcher frame for resting on an end of spread cloth, actuating means mounted on said cloth-laying machine for moving said end catcher means, first means mounting said end catcher means on said frame for vertical movement, second means for mounting said end catcher means for movement with said cloth-laying machine in the direction of machine travel to thereby maintain a predetermined minimum distance between said end catcher means and said machine during at least a portion of said travel with said machine, and engagement means mounted relative to said end catcher means for engagement by said actuating means to thereby effect said vertical movement and said movement with said machine, said end catcher frame comprising a base, first and second side frame members mounted on said base, said second means comprising first and second movable connections between said first and second side frame members, respectively, and said base, said first and second movable connections comprising first and second horizontal slots in said first and second side frame members, respectively, and first and second roller members mounted on said base for reception in said first and second slots, respectively.

2. An end catcher as set forth in claim 1 wherein said first means comprise third and fourth vertical slots in said first and second side frame members, respectively, third and fourth roller means mounted in said third and fourth slots, respectively, for movement in a vertical direction, and means mounting said end catcher means on said third and fourth roller means.

3. An end catcher as set forth in claim 2 including spring means effectively mounted between said base and said side frame members for biasing said frame sides toward said machine.

4. An end catcher as set forth in claim 3 wherein said actuating means comprises a bar mounted on said machine.

5. An end catcher as set forth in claim 4 wherein said actuating means comprises first and second cam means mounted on said end catcher means for effecting said vertical movement.

6. An end catcher as set forth in claim 5 including detent means for locking said cam means relative to said bar to maintain said predetermined minimum distance.

* * * * *